US006606469B2

(12) United States Patent
Kikuchi et al.

(10) Patent No.: US 6,606,469 B2
(45) Date of Patent: Aug. 12, 2003

(54) DEVELOPING APPARATUS MOUNTED ON IMAGE FORMING APPARATUS

(75) Inventors: Ken Kikuchi, Shizuoka (JP); Kazushi Watanabe, Shizuoka (JP); Toru Oguma, Shizuoka (JP); Akiyoshi Yokoi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/066,635

(22) Filed: Feb. 6, 2002

(65) Prior Publication Data

US 2002/0110383 A1 Aug. 15, 2002

(30) Foreign Application Priority Data

Feb. 9, 2001 (JP) ..... 2001-034155

(51) Int. Cl.[7] ..... G03G 15/08
(52) U.S. Cl. ..... 399/104; 399/103
(58) Field of Search ..... 399/98, 102, 103, 399/104, 105, 159, 222, 265, 274, 284

(56) References Cited

U.S. PATENT DOCUMENTS 5,134,960 A * 8/1992 Shirai ..... 399/105
5,488,462 A * 1/1996 Ishikawa et al. ..... 399/103
5,790,923 A * 8/1998 Oguma et al. ..... 399/106
6,038,414 A 3/2000 Inami et al. ..... 399/104
6,044,237 A * 3/2000 Numagami et al. ..... 399/104
6,160,976 A * 12/2000 Karakama et al. ..... 399/104

FOREIGN PATENT DOCUMENTS

JP 2000-131926 * 5/2000

* cited by examiner

*Primary Examiner*—Sandra Brase
(74) *Attorney, Agent, or Firm*—Fitzpatrick, Cella, Harper & Scinto

(57) ABSTRACT

A developing device including a developer bearing member for bearing and conveying a developer thereon, the developer bearing member having at a lengthwise end portion thereof a spacer for keeping a spacing between it and an image bearing member, a sealing member for preventing the leakage of the developer from the lengthwise end portions of the developer bearing member, a conductive member disposed in the vicinity of the sealing member, and an insulation member provided between the sealing member and the conductive member for electrically insulating the sealing member from the conductive member, the insulation member having a cleaning portion for cleaning the spacer.

6 Claims, 16 Drawing Sheets

DEVELOPING APPARATUS MOUNTED ON IMAGE FORMING APPARATUS

BACKGROUND OF THE INVENTION

1. Field of the Invention

The invention relates to a developing apparatus mounted on an image forming apparatus such as a copier or a printer, and particularly to a developing apparatus having a spacer for keeping a developing roller at a predetermined interval relative to an image bearing member such as a photosensitive member.

2. Description of Related Art

For example, in an image forming apparatus using the electrophotographic process, when the use thereof reaches a long time, the interchange of a photosensitive drum, the supply or interchange of a developer and the adjustment, cleaning and interchange of others (such as a charger and a cleaning container) become necessary, but such maintenance work has been virtually difficult to other persons than a serviceman having expert knowledge.

So, in an image forming apparatus using an image forming process of the electrophotographic type, there is adopted a process cartridge system in which a photosensitive drum and process means for acting on the photosensitive drum are integrally made into a cartridge which is detachably mountable on the image forming apparatus. According to the process cartridge system, the maintenance of the apparatus can be done by a user himself without resort to a serviceman and therefore, the operability of the apparatus can be markedly improved.

FIG. 16 of the accompanying drawings is a schematic cross-sectional view showing a process cartridge according to the conventional art.

The process cartridge B is comprised of a developing unit 12 comprising a developing apparatus 9 having a developing roller 9*c*, a regulating blade 9*d*, etc., and a toner frame 11 having a toner container 11A, the developing apparatus 9 and the toner frame 11 being joined together by welding, and a cleaning frame 13 supporting a cleaning container 10 having a photosensitive drum 7, a charging roller 8 and a cleaning blade 10*a*. The developing unit 12 is pivotally supported by a coupling pin 22, and the developing roller 9*c* is biased toward the photosensitive drum 7 side by a compression coil spring 22*a*.

In this case, in order that the photosensitive drum 7 and the developing roller 9*c* may maintain an appropriate gap therebetween, spacer runners 9*i* are provided at the lengthwisely opposite ends of the developing roller 9*c*, and the appropriate gap between the developing roller 9*c* and the photosensitive drum 7 is maintained by the abutted position of the spacer runners 9*i* and the photosensitive drum 7.

Now, when effecting image formation with the above-described process cartridge B according to the conventional art mounted on an image forming apparatus, a small amount of toner is scattered outwardly from around the developing roller 9*c* during the development by the developing roller 9*c* of the developing apparatus 9.

If the scattered toner adheres to the peripheral surfaces of the spacer runners 9*i* provided at the lengthwisely opposite ends of the developing roller 9*c*, the appropriate gap between the developing roller 9*c* and the photosensitive drum 7 becomes unmaintainable and bad development occurs, and this has led to the problem that good images become unobtainable for a long period.

SUMMARY OF THE INVENTION

The present invention has been made in view of the above-noted problem and an object thereof is to provide a developing apparatus in which the gap between an image bearing member and a developing roller can be accurately maintained for a long period.

Another object of the present invention is to provide a developing apparatus in which a spacer for determining the gap between an image bearing member and a developing roller can be cleaned by a simple method.

Still another object of the present invention is to provide a developing apparatus in which electrical leak can be prevented and yet the cleaning of a spacer can be effected.

Yet still another object of the present invention to provide a developing apparatus comprising:

a developer bearing member for bearing and conveying a developer thereon, the developer bearing member having at a lengthwise end portion thereof a spacer for keeping a spacing between the developer bearing member and an image bearing member;

a sealing member for preventing the leakage of the developer from the lengthwise end portion of the developer bearing member;

a conductive member disposed in the vicinity of the sealing member; and an insulation member provided between the sealing member and the conductive member for electrically insulating the sealing member from the conductive member, the insulation member having a cleaning portion for cleaning the spacer.

Further objects of the present invention will become apparent from the following detailed description when read with reference to the accompanying drawings.

DESCRIPTION OF THE PREFERRED EMBODIMENTS

Figure 1:
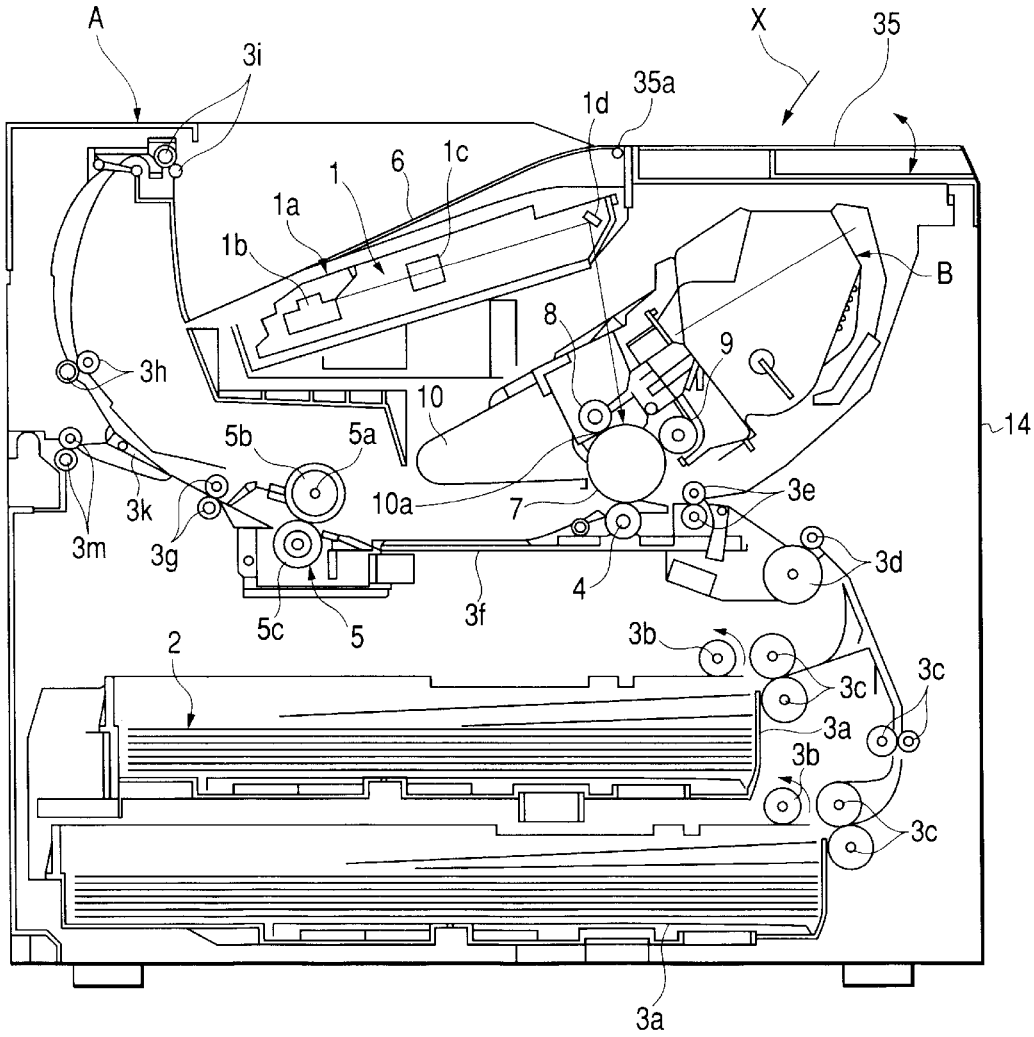
FIG. 1 schematically shows the construction of an image forming apparatus provided with a process cartridge according to an embodiment of the present invention.
Figure 2:
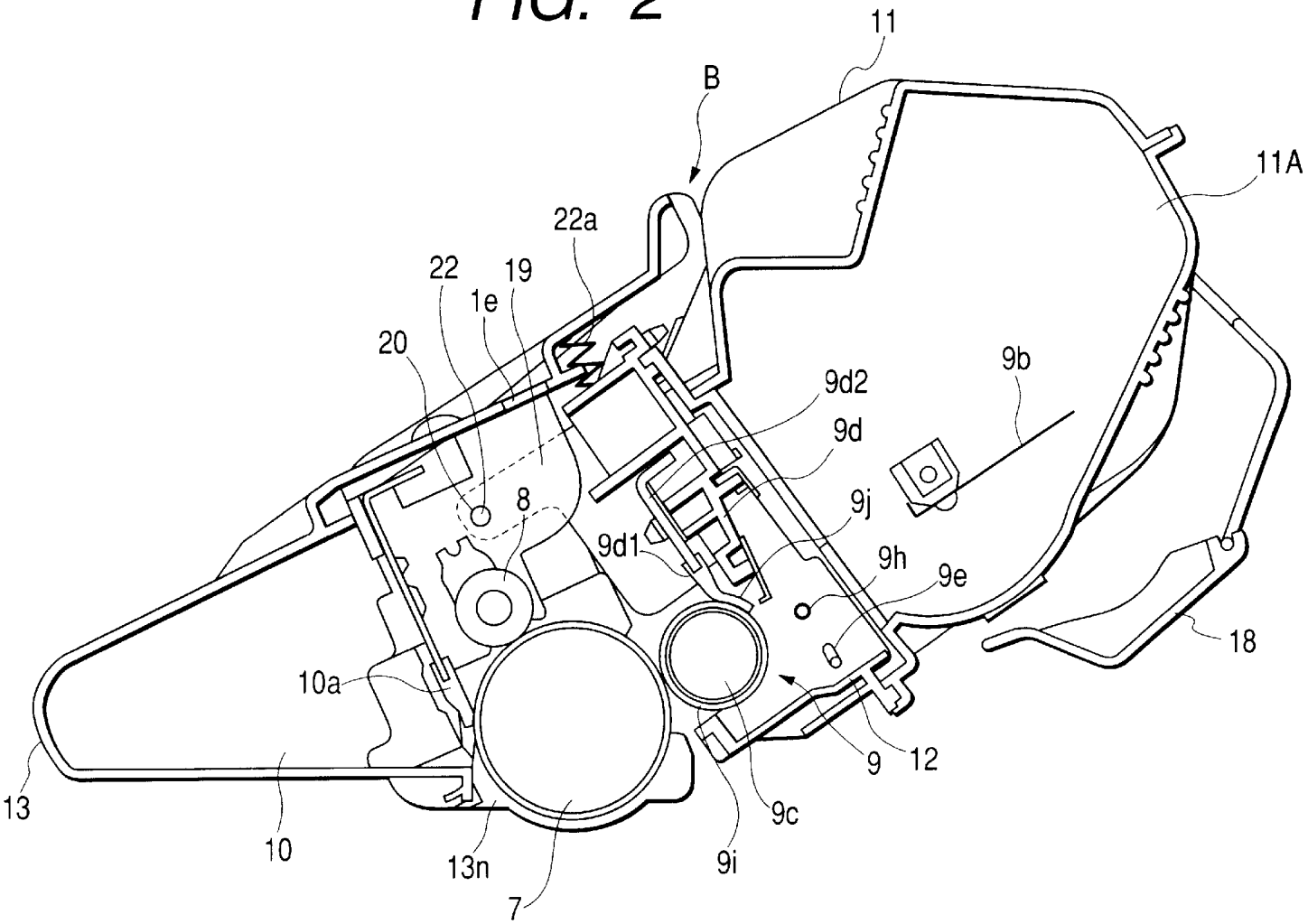
FIG. 2 is a side cross-sectional view showing the process cartridge according to the embodiment of the present invention.
Figure 16:
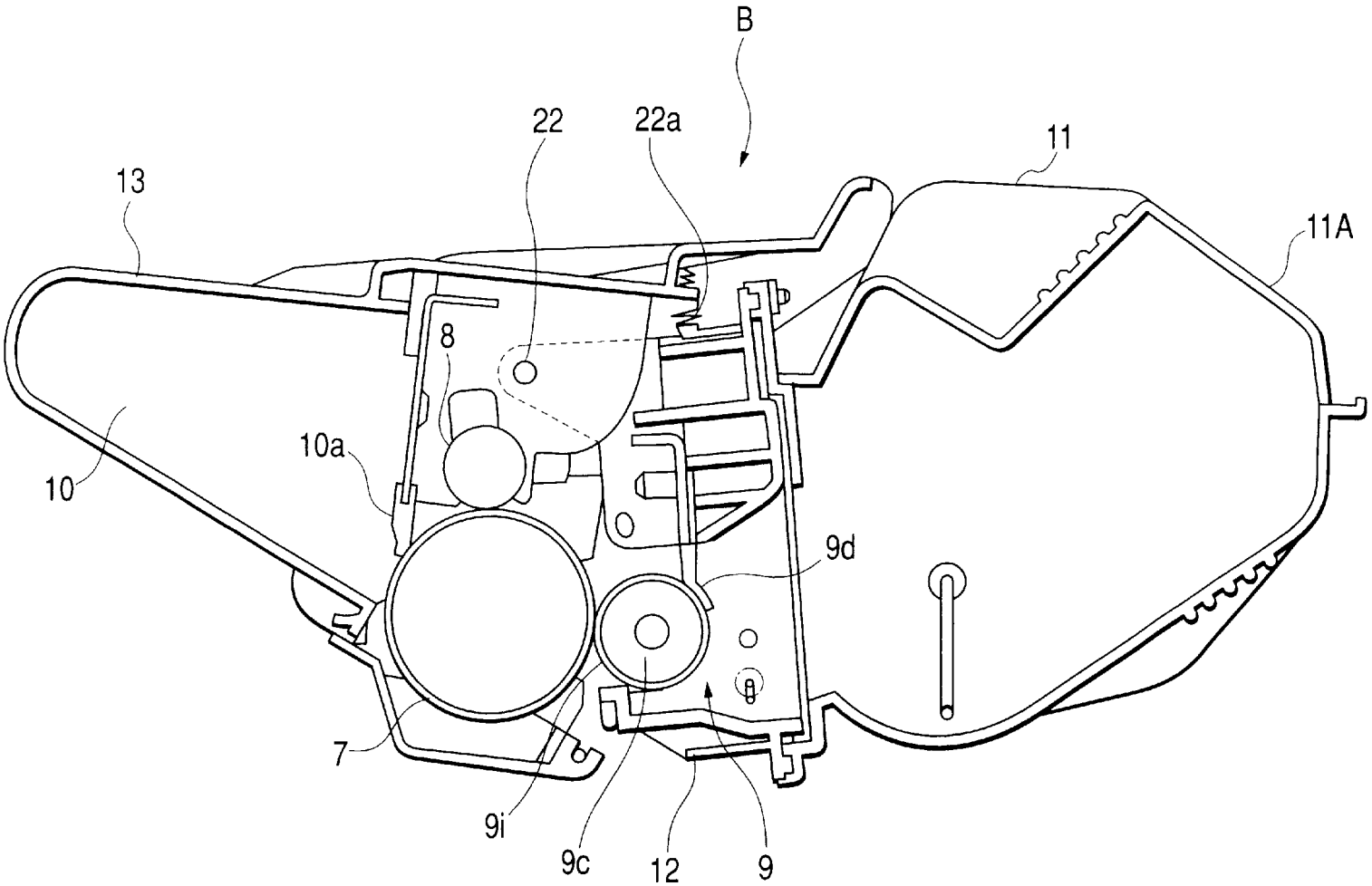
FIG. 16 is a side cross-sectional view showing a process cartridge according to the conventional art.

FIG. 1 schematically shows the construction of an image forming apparatus (in the present embodiment, a laser beam printer of the electrophotographic type) provided with a process cartridge according to an embodiment of the present invention, and FIG. 2 is a schematic cross-sectional view showing the process cartridge according to the embodiment of the present invention. In the embodiments of the invention, the same members as the constituent members of the process cartridge according to the conventional art shown in FIG. 16 are given the same reference characters.

The image forming apparatus (laser beam printer) A transfers a toner image formed on a photosensitive drum 7 as an image bearing member by the electrophotographic image forming process to a recording medium (such as paper or an OHP sheet) 2 to thereby effect image formation.

Specifically, the photosensitive drum 7 being rotated is charged by a charging roller 8 as charging means, and then a laser beam conforming to image information inputted from an exposing apparatus 1 is applied to the photosensitive drum 7 to thereby form an electrostatic latent image conforming to the image information on the photosensitive drum 7. The exposing apparatus 1 causes the laser beam applied from a laser diode 1*a* in conformity with the image information to be reflected by a polygon mirror 1*b*, and scan and expose the surface of the photosensitive drum 7 through a lens 1*c* and a reflecting mirror 1*d*.

The electrostatic latent image is developed with the toner (developer) of an developing apparatus 9 to thereby form a toner image. The developing apparatus 9, as shown in FIG. 2, feeds the toner in a toner container 11A to a developing roller 9*c* by the rotation of a toner feeding member 9*b*. A developing roller 9*c* containing a stationary magnet (not shown) therein is rotated and also, a toner layer having triboelectrification charges induced therein is formed on the surface of the developing roller 9*c* by the elastic member 9*d*1 of a regulating blade 9*d*, and the toner is supplied to the developing area of the photosensitive drum 7. The toner is shifted to the electrostatic latent image on the photosensitive drum 7 to thereby form a visible toner image. The toner as the developer used in the present embodiment is a monocomponent magnetic toner having magnetic particles dispersed in resin.

In synchronism with the formation of the toner image, recording mediums 2 such as sheets of a predetermined size set in a plurality of feed cassettes 3*a* are transported one by one to the transferring nip portion between the photosensitive drum 7 and a transferring roller 4 as transferring means by a pickup roller 3*b*, pairs of transporting rollers 3*c* and 3*d* and a pair of registration rollers 3*e*.

The toner image formed on the photosensitive drum 7 is transferred to the recording medium 2 by the transferring roller 4 to which a transferring bias is applied. Thereafter, the recording medium 2 having received the transfer of the toner image thereto is transported to a fixing device 5 as fixing means by a transport guide 3*f*. The fixing device 5 has a driving roller 5*c* and a fixing roller 5*b* containing a heater 5*a* therein, and nips and transports the recording medium 2 having the toner image transferred thereto by the fixing nip portion between the driving roller 5*c* and the fixing roller 5*b*, and applies heat and pressure to the passing recording mediums 2 to thereby fix the transferred toner image.

The recording medium 2 on which the toner image has been fixed is transported by pairs of delivery rollers 3*g*, 3*h* and 3*i* and is delivered to a delivery tray 6. The delivery tray 6 is provided on the upper surface of the main body 14 of the image forming apparatus. A pivotable flapper 3*k* can also be operated to thereby deliver the recording medium 2 on which the toner image has been fixed from a side surface of the main body 14 of the image forming apparatus by a pair of delivery rollers 3*m*.

After the toner image has been transferred to the recording medium 2, any residual tone on the photosensitive drum 7 is removed by the cleaning blade 10*a* of a cleaning container 10, and the photosensitive drum becomes ready for the next image forming operation.

In the image forming apparatus A of the present embodiment, the photosensitive drum 7, the charging roller 8, the developing apparatus 9 and the cleaning container 10 are integrally made into a cartridge as a process cartridge B, which is detachably mounted on the main body 14 of the image forming apparatus.

The process cartridge B, as shown in FIG. 2, is provided with a toner frame 11 having a toner container 11A containing the toner therein, a developing frame 12 having the developing apparatus 9, the photosensitive drum 7, the charging roller 8 and a cleaning frame 13 having the cleaning container 10 and the cleaning blade 10*a*. The process cartridge B is detachably mountable to a cartridge mounting guide (not shown) as mounting means provided in the main body 14 of the image forming apparatus.

Specifically, the cartridge mounting guide is provided in a cartridge mounting space which appears by a cover 35 shown in FIG. 1 being opened into its open state. The cartridge mounting guide is provided with groove-shaped guide portions (16*a* and 16*c* in FIGS. 11 and 12) inclined in the direction indicated by the arrow X in FIG. 1, and guides positioning guide members (13*a*R and 13*a*L in FIGS. 3 and 5) provided on the right and left end portions of the process cartridge B.

The process cartridge B is inserted in the direction indicated by the arrow X in FIG. 1 along the guide portion, and the cover 35 is closed to thereby complete the mounting of the process cartridge B onto the main body 14 of the image forming apparatus. When the process cartridge B is to be taken out of the main body 14 of the image forming apparatus, an operation converse to the above-described mounting operation is performed.

Also, the process cartridge B is provided with an exposure opening portion 1*e* for applying light conforming to the image information from the exposing apparatus 1 to the photosensitive drum 7, and a transfer opening portion 13*n* for opposing the photosensitive drum 7 to the transfer material 2. Specifically, the exposure opening portion 1*e* is provided in the cleaning frame 13, and the transfer opening portion 13*n* is constructed between the developing frame 12 and the cleaning frame 13. The construction of the process cartridge B in the present embodiment will hereinafter be described in detail.

(Construction of the Housing of the Process Cartridge B)

The process cartridge B according to the present embodiment, as described above, constitutes a housing by the toner frame 11, the developing frame 12 and the cleaning frame 13 being coupled together.

As shown in FIG. 2, a toner feeding member 9*b* is rotatably provided in the toner frame 11. The developing roller 9*c* and the regulating blade 9*d* are provided in the developing frame 12, and an agitating member 9*e* for circulating the toner in the developing apparatus 9 is rotatably provided in the vicinity of the developing roller 9*c*. Also, an antenna rod 9*h* is provided on the developing frame 12 opposite to the developing roller 9*c* and substantially in parallelism to the developing roller 9*c* along the lengthwise direction of the developing roller 9*c*. Further, the toner frame 11 is provided with a drum shutter member 18 for covering the photosensitive drum 7 to thereby protect the photosensitive drum 7 from being exposed to light for a long time or from contacting with foreign substances when the process cartridge B is detached from the main body 14 of the image forming apparatus.

The elastic member 9*d*1 of the regulating blade 9*d*, a holding member 9*d*2 for the elastic member 9*d*1, a spacer runner 9*i* and an insulation sheet member 9*j* shown in FIG. 2 will be described later.

Figure 8:
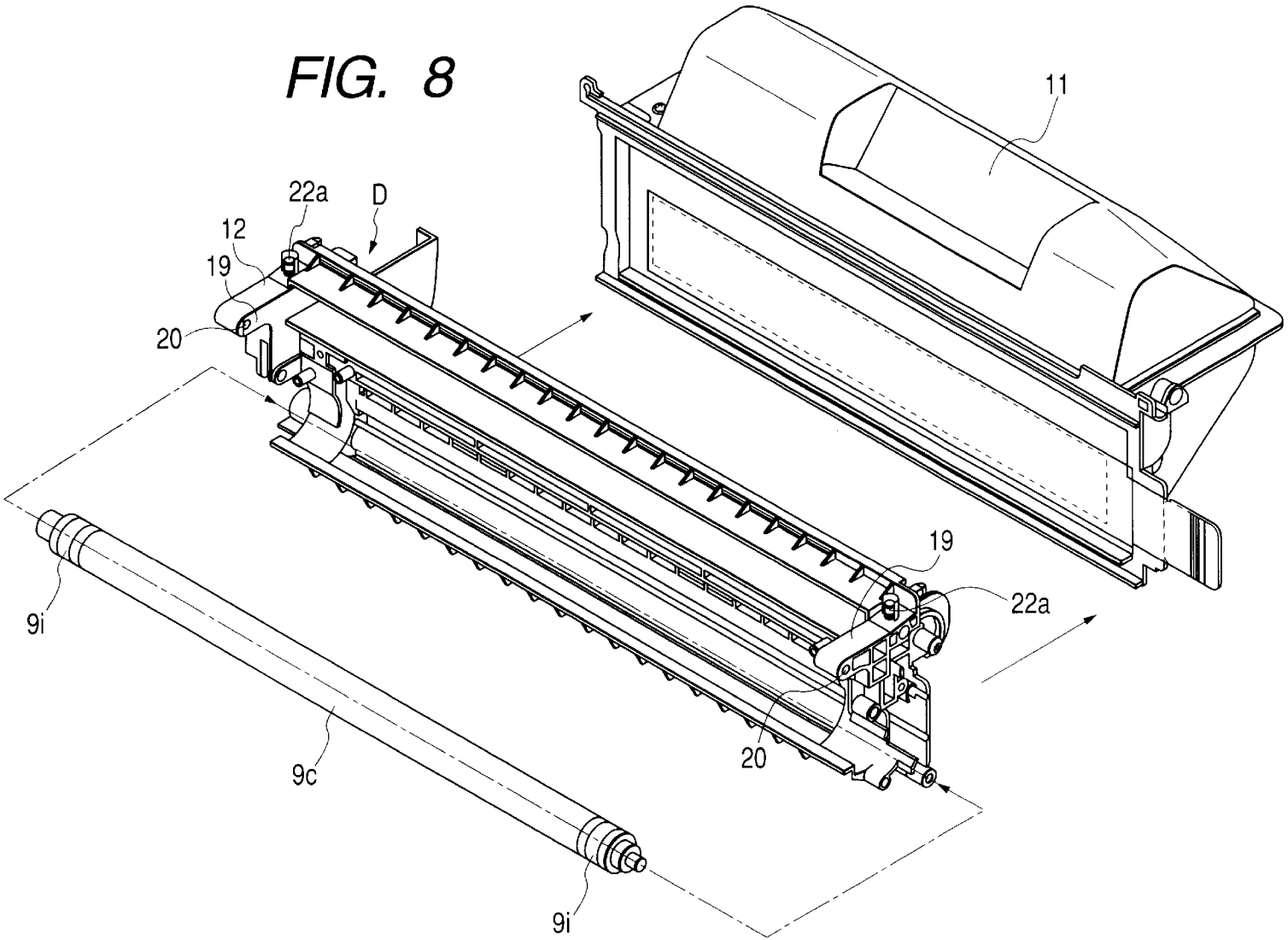
FIG. 8 is an exploded perspective view showing the developing unit, the developing roller unit and the toner container unit of the process cartridge according to the embodiment of the present invention.

The toner frame 11 and the developing frame 12 are welded together (in the present embodiment, ultrasonically welded together) to thereby constitute an integral developing unit D (see FIG. 8). Also, the photosensitive drum 7, the charging roller 8 and the cleaning container 10 are mounted in the cleaning frame 13, whereby a cleaning unit C (see FIG. 9) is constituted.

The cleaning unit C and the developing unit D are pivotally coupled together by round pin-shaped connecting members 22, whereby the process cartridge B is constituted. That is, as shown in FIG. 8, circular pivot holes 20 parallel to the developing roller 9*c* are formed in the distal ends of arm portions 19 formed on the lengthwisely opposite ends of the developing frame 12 (the axially opposite ends of the developing roller 9*c*).

Figure 9:
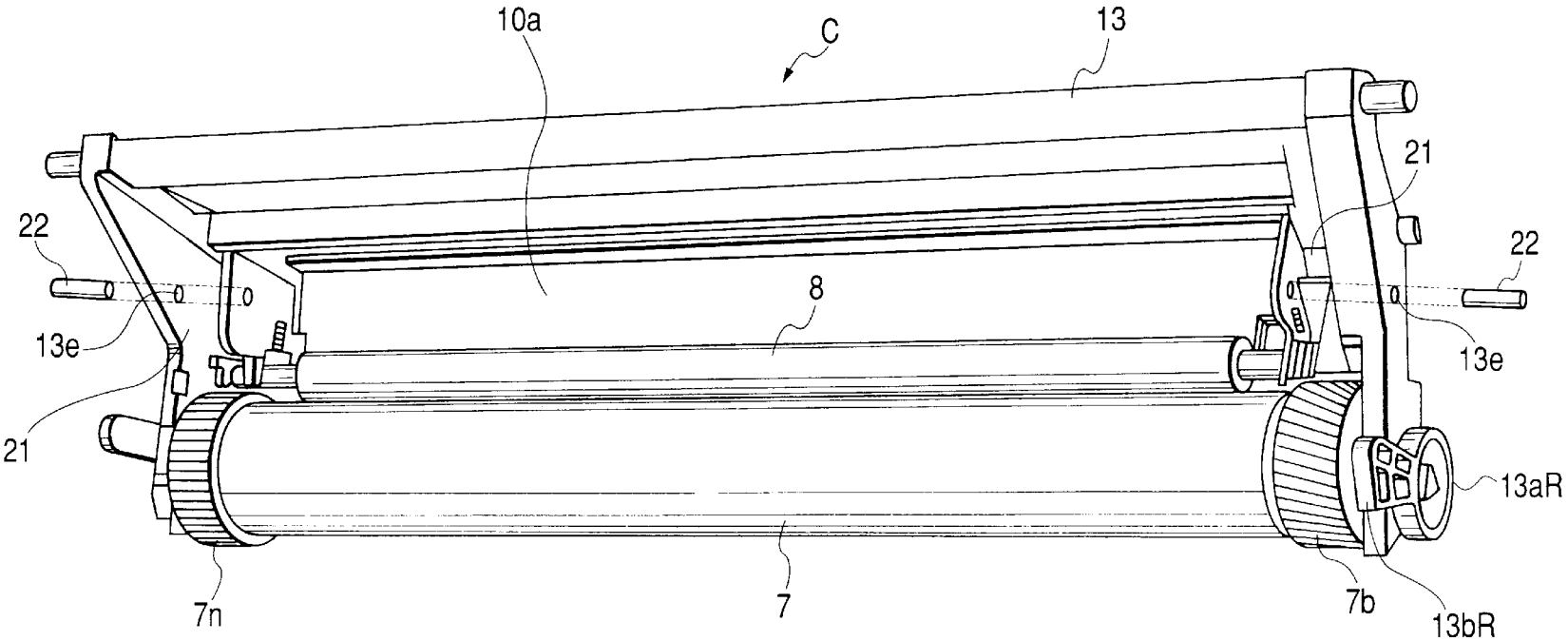
FIG. 9 is a perspective view showing the cleaning unit of the process cartridge according to the embodiment of the present invention.

On the other hand, recesses 21 for permitting the arm portions 19 to enter thereinto are formed in the lengthwisely opposite ends of the cleaning frame 13 (see FIG. 9). As shown in FIGS. 8 and 9 the arm portions 19 are inserted into the recesses 21, and the connecting members 22 are forced into attachment holes 13*e* in the cleaning frame 13 and are fitted into the pivot holes 20 in the ends of the arm portions 19 and are further forced into inner holes 13*e*, whereby the developing unit D and the cleaning unit C are coupled together for pivotal movement about the connecting members 22.

At this time, compression coil springs 22*a* inserted into dowels (not shown) provided on the base sides of the arm portions 19 strike against the upper walls of the recesses 21 of the cleaning frame 13, and the developing frame 12 is downwardly biased by these compression coil springs 22*a*, whereby the developing roller 9*c* is brought into contact with the photosensitive drum 7 by a constant biasing force.

(Construction of the Guide Means of the Process Cartridge B and the Main Body 14 of the Image Forming Apparatus)

Figure 3:
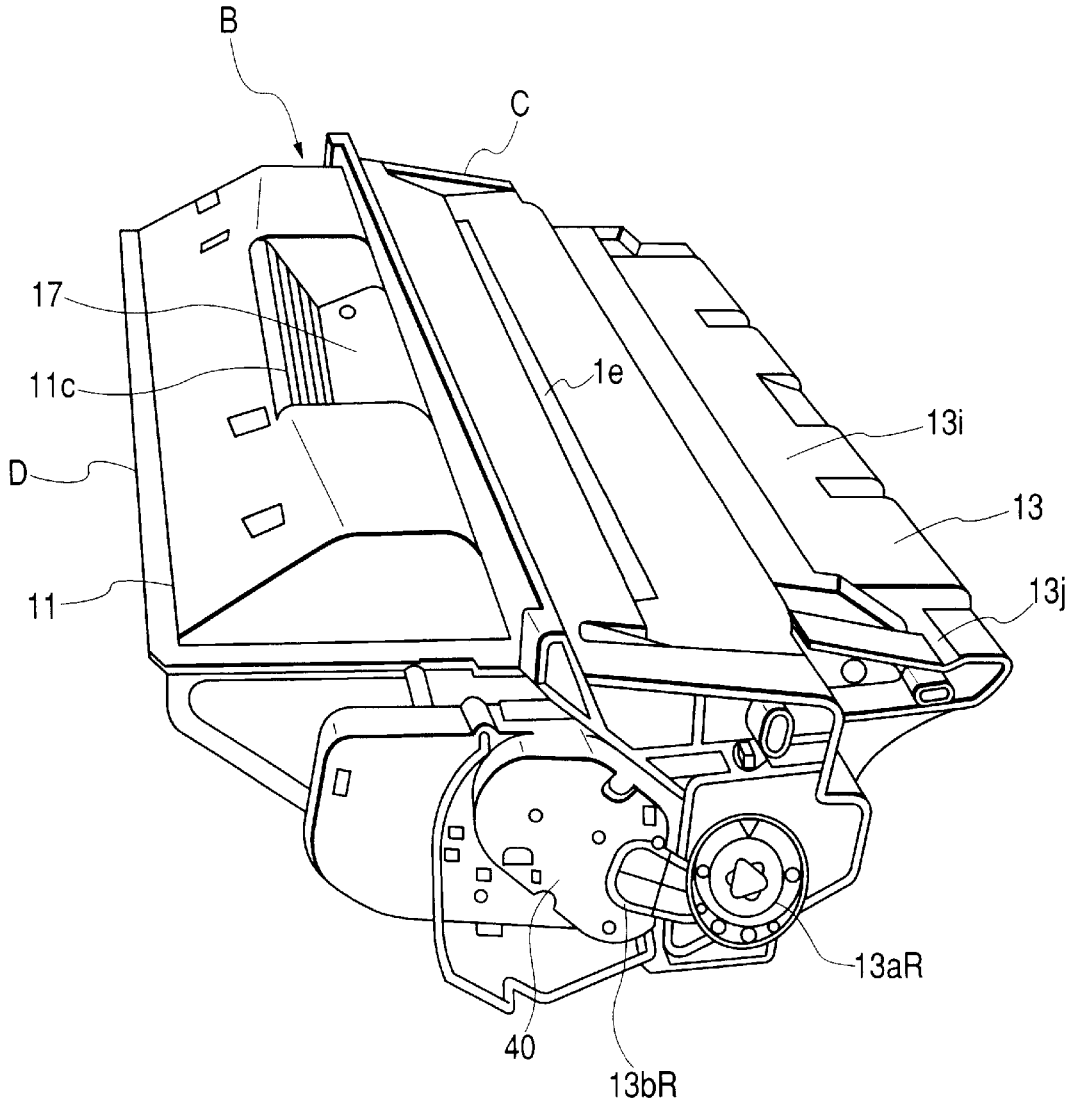
FIG. 3 is a perspective view showing the process cartridge according to the embodiment of the present invention.
Figure 5:
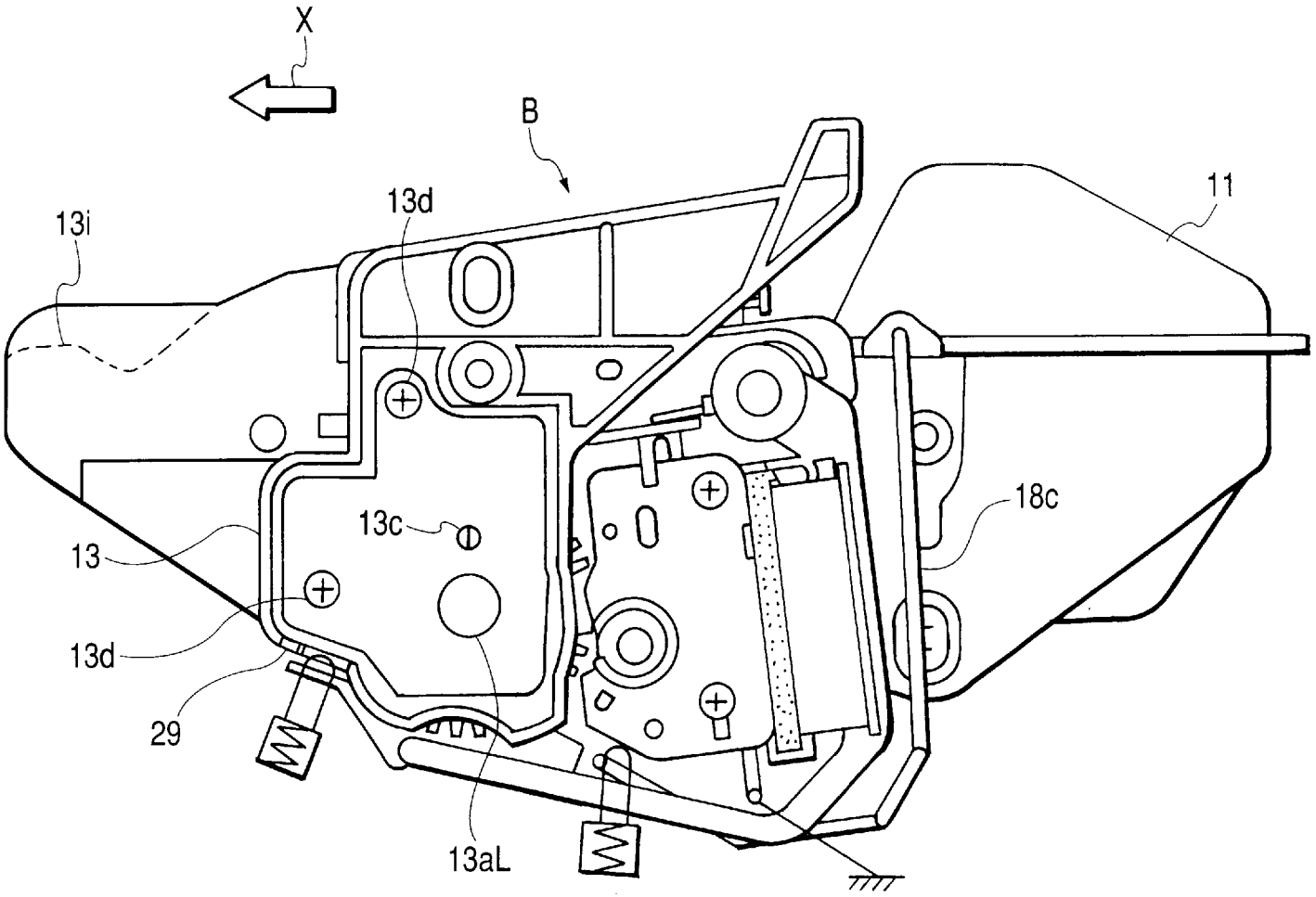
FIG. 5 is a side view showing the process cartridge according to the embodiment of the present invention.
Figure 6:
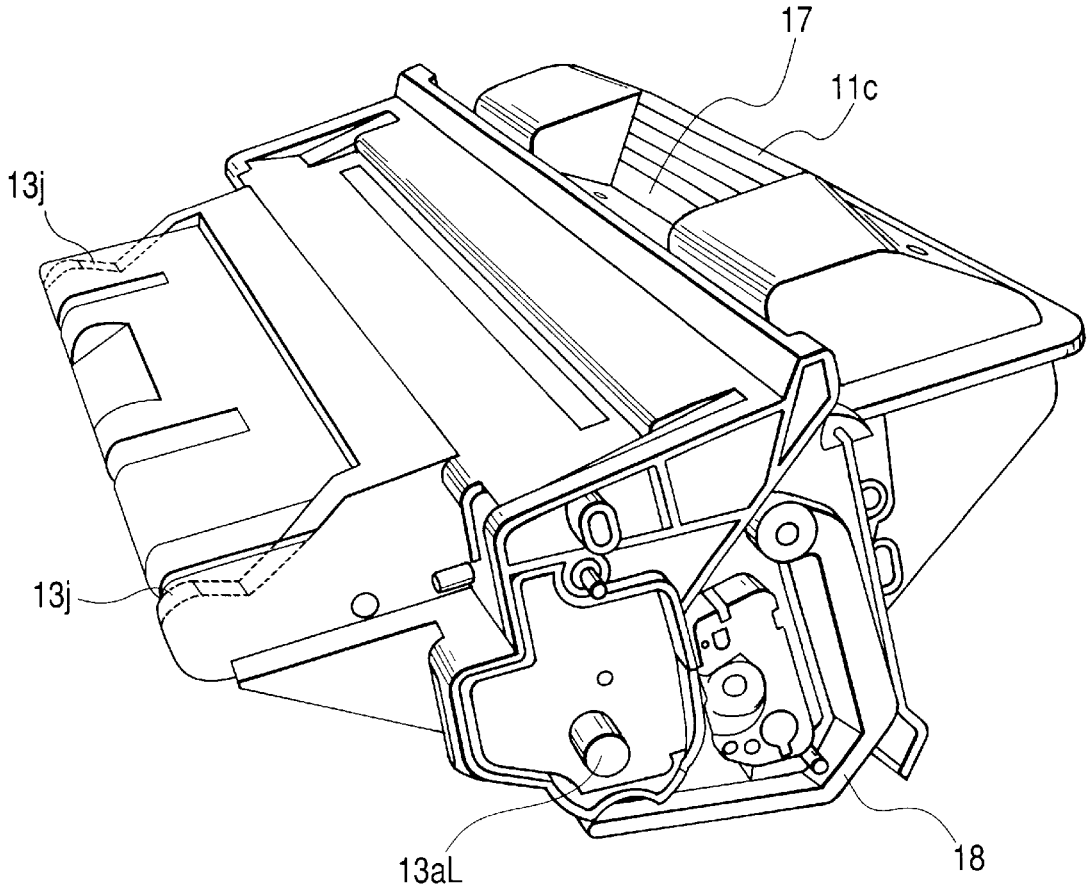
FIG. 6 is a perspective view showing the process cartridge according to the embodiment of the present invention.
Figure 7:
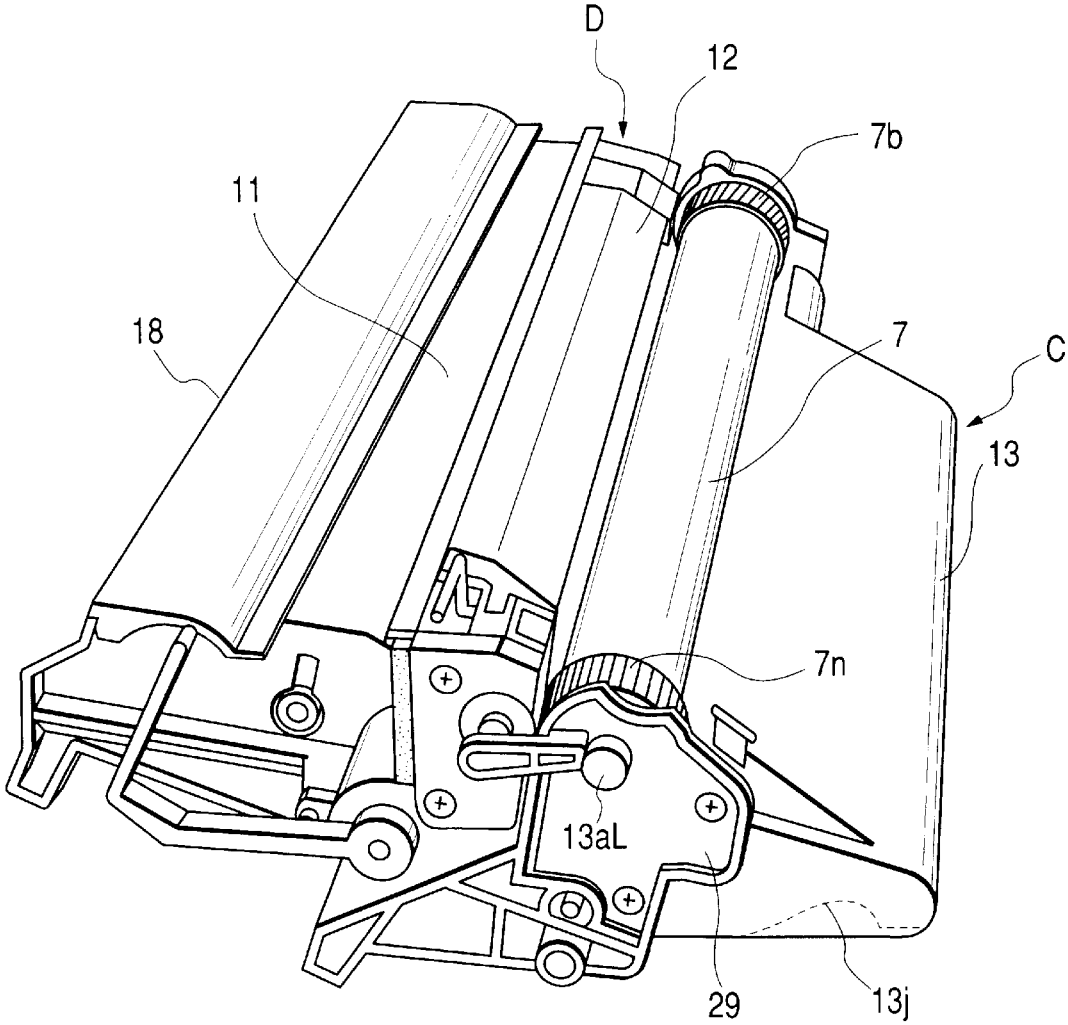
FIG. 7 is a perspective view showing the process cartridge according to the embodiment of the present invention.

Guide means used when the process cartridge B is mounted on and dismounted from the main body 14 of the image forming apparatus will now be described with reference to FIGS. 3 to 7. FIG. 3 is a perspective view of the process cartridge B as it is seen from one lengthwise end thereof, FIG. 4 is a side view of the process cartridge B as it is seen from one side thereof, FIG. 5 is a side view of the process cartridge B as it is seen from the other side thereof, FIG. 6 is a perspective view of the process cartridge B as it is seen from the other lengthwise end thereof, and FIG. 7 is a perspective view of the process cartridge B as it is seen from the photosensitive drum 7 side.

Guide means serving as guides when the process cartridge B is mounted on and dismounted from the main body 14 of the image forming apparatus are provided on the opposite outer sides of the cleaning frame 13, as shown in FIGS. 3 to 7. That is, the guide means are comprised of cylindrical guides 13*a*R and 13*a*L as positioning guide members, and a detent guide 13*b*R as a guide member, which is posture holding means during mounting and dismounting.

Figure 4:
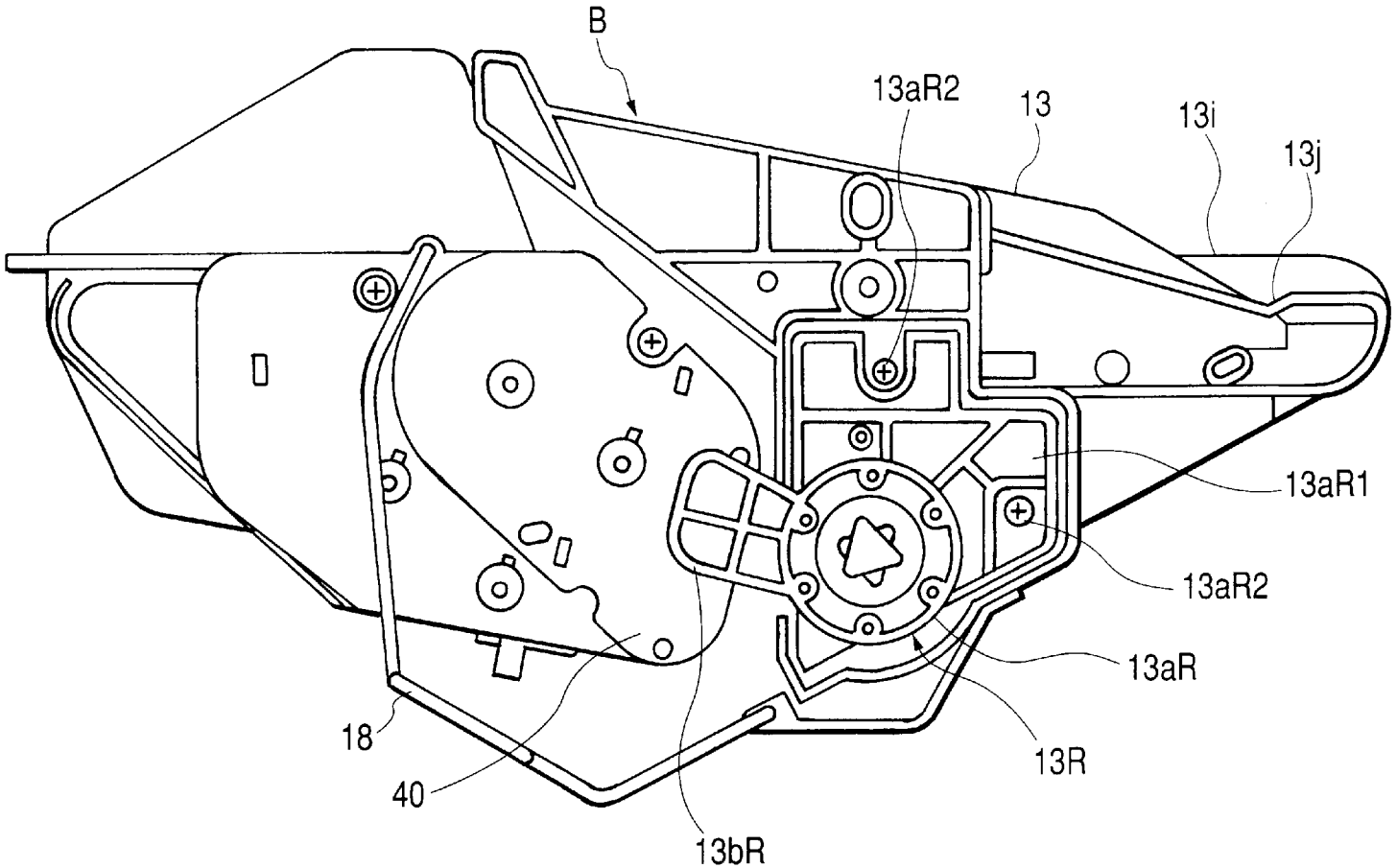
FIG. 4 is a side view showing the process cartridge according to the embodiment of the present invention.

As shown in FIG. 4, the cylindrical guide 13*a*R is a hollow cylindrical member, and the detent guide 13*b*R is formed integrally with the cylindrical guide 13*a*R, and substantially radially protrudes integrally from the circumference of the cylindrical guide 13*a*R. An attachment flange 13*a*R1 is integrally provided on the cylindrical guide 13*a*R. A right guide member 13R having the cylindrical guide 13*a*R, the detent guide 13*b*R and the attachment flange 13*a*R1, as described above, is fixed to the cleaning frame 13 with each small screw 13*a*R2 inserted and screwed into the small screw hole of the attachment flange 13*a*R1.

The detent guide 13*b*R of the right guide member 13R fixed to the cleaning frame 13 is disposed on a side of the developing frame 12 so as to extend sideways of a developing holder 40 fixed to the developing frame 12.

Figure 10:
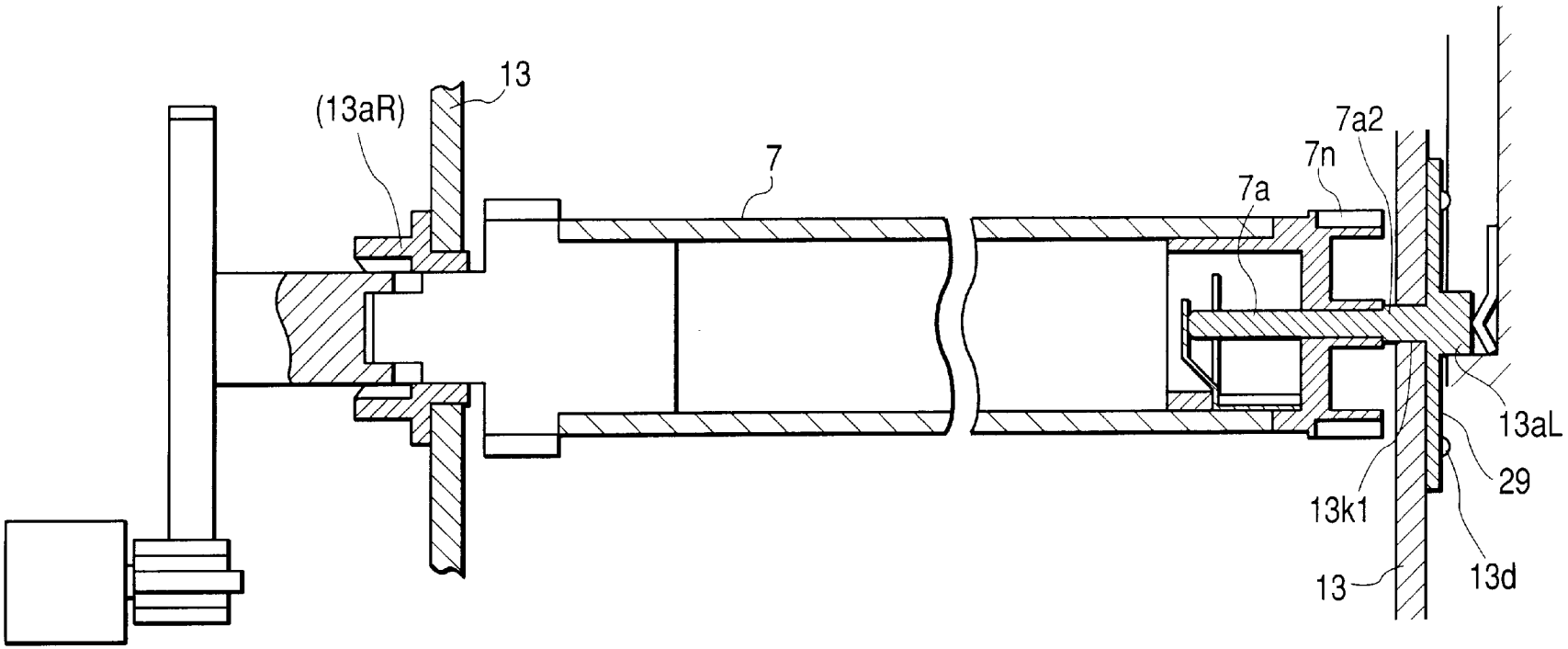
FIG. 10 is a cross-sectional view showing a photosensitive drum in the embodiment of the present invention.

Also, as shown in FIG. 10, a fixed drum shaft 7*a* for rotatably supporting a spur gear 7*n* fitted in the photosensitive drum 7 is provided inside a flange 29, and the enlarged diameter portion 7*a*2 of the drum shaft 7*a* is fitted in a hole 13*k*1 in the cleaning frame 13. As shown in FIG. 5, the cylindrical guide 13*a*L is outwardly (toward this side orthogonal to the plane of the drawing sheet of FIG. 5) protrudingly provided on a flat plate-like flange 29 fitted against rotation on a positioning pin 13*c* protruding on a side of the cleaning frame 13, and fixed to the cleaning frame 13 by small screws 13*d*.

The cylindrical guide 13*a*L and the drum shaft 7*a* are coaxial with each other, and the cylindrical guide 13*a*L, the drum shaft 7*a* and the flange 29 are integral with one another or are integrally formed of a metallic material, e.g. iron material.

As shown in FIG. 9, the spur gear 7*n* is provided on the axial end portion of the photosensitive drum 7 which is opposite to a drum gear 7*b* which is a helical gear. The spur gear 7*n*, when the process cartridge B is mounted on the main body 14 of the image forming apparatus, meshes with a gear (not shown) coaxial with the transferring roller 4 provided in the main body 14 of the image forming apparatus to thereby transmit a driving force for rotating the transferring roller 4 from the process cartridge B.

Regulating abutting portions 13*j* are provided on the right and left ends of the upper surface 13*i* of the cleaning unit C as viewed in the direction orthogonal to the mounting direction (X direction) of the process cartridge. The upper surface 13*i* of the cleaning unit C is a surface located above when the process cartridge B is mounted on the main body 14 of the image forming apparatus.

The regulating abutting portions 13*j* regulate the position of the process cartridge B when the process cartridge B is mounted on the main body 14 of the image forming apparatus. That is, when the process cartridge B is mounted on the main body 14 of the image forming apparatus, the regulating abutting portion 13*j* abuts against a fixed member 25 (see FIGS. 11 and 12) provided in the main body 14 of the image forming apparatus, whereby the pivotally moved position of the process cartridge B about the cylindrical guides 13*a*R and 13*a*L is regulated.

Figure 11:
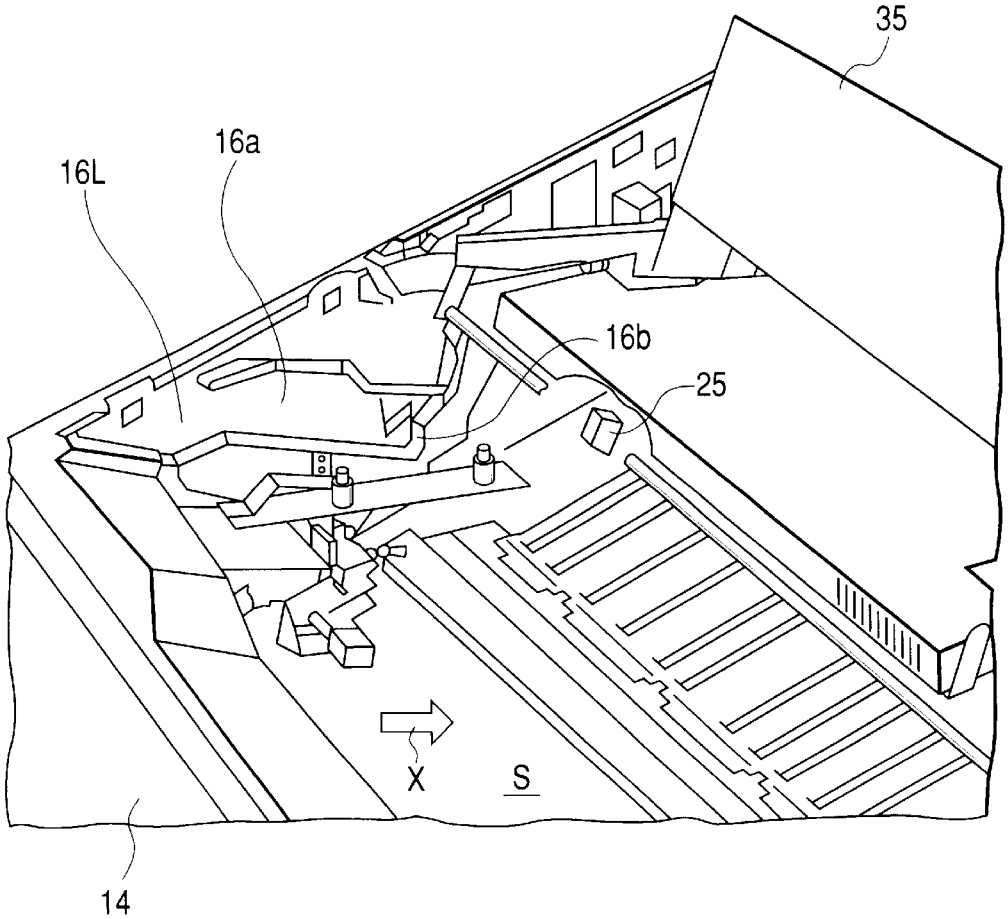
FIG. 11 is a perspective view showing the process cartridge mounting portion of the main body of an image forming apparatus in the embodiment of the present invention.
Figure 12:
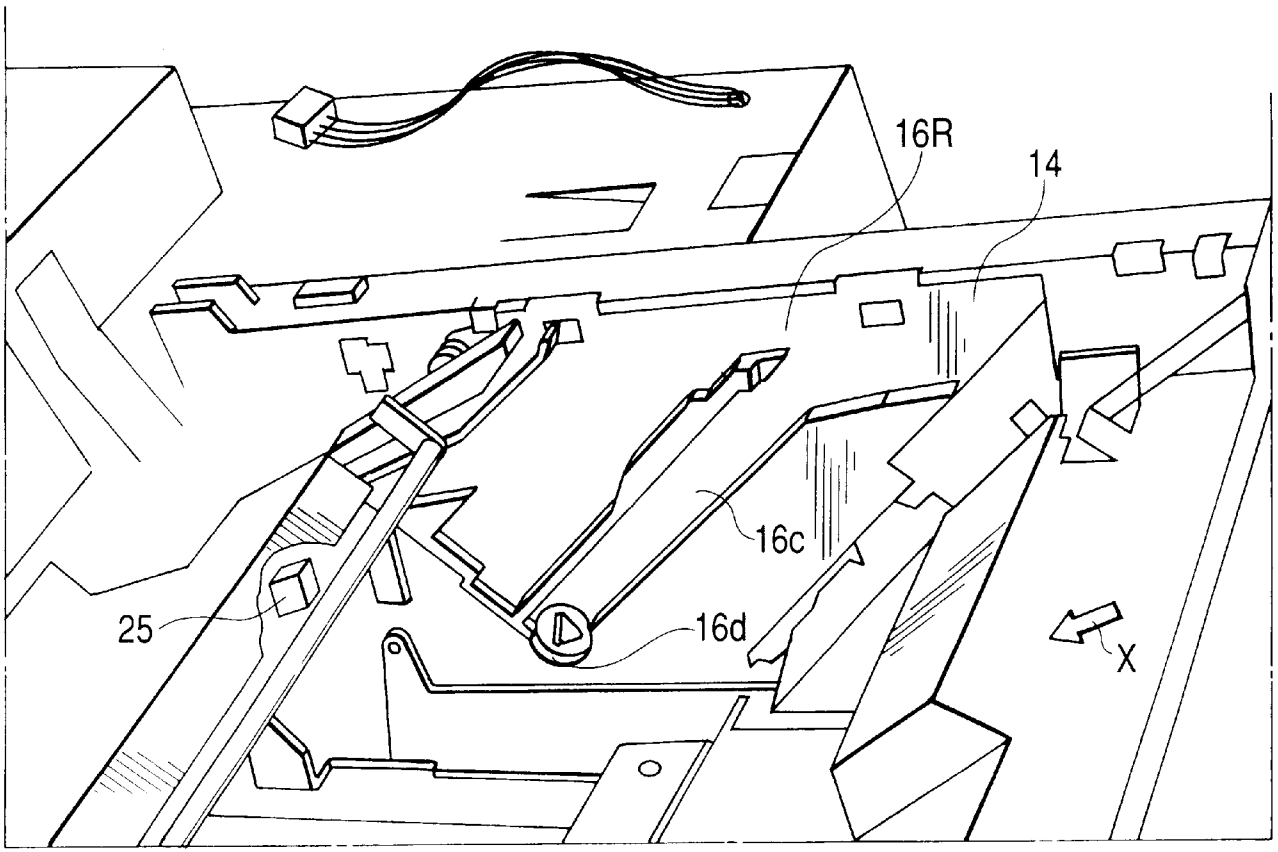
FIG. 12 is a perspective view showing the process cartridge mounting portion of the main body of the image forming apparatus in the embodiment of the present invention.

Description will now be made of the guide means on the main body 14 side of the image forming apparatus. When the cover 35 of the main body 14 of the image forming apparatus is pivotally moved in a counter-clockwise direction about a fulcrum 35*a* as viewed in FIG. 1, the upper portion of the main body 14 of the image forming apparatus is opened (see FIGS. 11 and 12). Guide members 16R and 16L are provided on the left side and the right side, respectively, of the inner walls on the right and left sides of the main body 14 of the image forming apparatus from an opening portion in which the cover 35 is opened as viewed from the mounting and dismounting direction of the process cartridge B, as shown in FIGS. 11 and 12, respectively.

The guide members 16R and 16L are provided with guide portions 16*a* and 16*c* obliquely provided so as to be forwardly downwardly inclined as viewed along the direction indicated by the arrow X which is the direction of insertion of the process cartridge B, and semicircular positioning grooves 16*b* and 16*d* connected to the guide portions 16*a* and 16*c*, respectively, and into which the cylindrical guides 13*a*R and 13*a*L of the process cartridge B are just fitted. The peripheral walls of the positioning grooves 16*b* and 16*d* are cylindrical. The centers of the positioning grooves 16*b* and 16*d* are aligned with the centers of the cylindrical guides 13*a*R and 13*a*L of the process cartridge B and also aligned with the center line of the photosensitive drum 7 when the process cartridge B is mounted on the main body 14 of the image forming apparatus.

The width of the guide portions 16*a* and 16*c* is a width enough to permit the cylindrical guides 13*a*R and 13*a*L to loosely fit thereto as viewed from the mounting and dismounting direction of the process cartridge B. The detent guide 13*b*R having a width smaller than the diameter of the cylindrical guide 13*a*R loosely fits to the latter as a matter of course, but the cylindrical guides 13*a*R, 13*a*L and the detent guide 13*b*R are limited in pivotal movement by the guide portion 16*a*, and the process cartridge B is mounted with its predetermined range of posture kept.

In a state in which the process cartridge B has been mounted on the main body 14 of the image forming apparatus, the cylindrical guides 13*a*R and 13*a*L of the process cartridge B fit into the positioning grooves 16*b* and 16*d*, respectively, of the guide members 13R and 13L, and the right and left regulating abutting portions 13*j* of the distal end of the cleaning frame 13 of the process cartridge B abut against the fixed member 25 of the main body 14 of the image forming apparatus.

The process cartridge B is of such a weight distribution relative to a center line passing through the centers of the cylindrical guides 13*a*R and 13*a*L that when the center line is kept horizontal on the cleaning unit C side and the developing unit D side, the developing unit D side will create a greater primary moment than the cleaning unit C side.

When the process cartridge B is to be mounted on the main body 14 of the image forming apparatus, the ribs 11*c* of the recess 17 side and the lower side of the toner frame 11 are gripped by a hand, and the cylindrical guides 13*a*R and 13*a*L are inserted into the guide portions 16*a* and 16*c*, respectively, of the cartridge mounting portion of the main body 14 of the image forming apparatus, and subsequently, with the process cartridge B being forwardly downwardly inclined as viewed along the direction of insertion, the detent guide 13*b*R is inserted into the guide portions 16*a* and 16*c* of the main body 14 of the image forming apparatus.

Thereupon, the cylindrical guides 13*a*R, 13*a*L and detent guide 13*b*R of the process cartridge B advance to the inner part side along the guide portions 16*a* and 16*c* of the main body 14 of the image forming apparatus, and the cylindrical guides 13*a*R and 13*a*L of the process cartridge B arrive at the positioning grooves 16*b* and 16*d*, respectively, of the main body 14 of the image forming apparatus, whereupon the cylindrical guides 13*a*R and 13*a*L are seated in the positions of the positioning grooves 16*b* and 16*d* by the gravity of the process cartridge B. Thereby, the cylindrical guides 13*a*R and 13*a*L of the process cartridge B are accurately positioned relative to the positioning grooves 16*b* and 16*d*.

Since the center line passing through the centers of the cylindrical guides 13*a*R and 13*a*L is the center line of the photosensitive drum 7, the photosensitive drum 7 is roughly positioned in the main body 14 of the image forming apparatus. Finally, in a state in which the couplings are coupled together, the photosensitive drum 7 is positioned relative to the main body 14 of the image forming apparatus.

In this state, there is a slight gap between the fixed member 25 of the main body 14 of the image forming apparatus and the regulating abutting portion 13*j* of the process cartridge B. Here, when the hand holding the process cartridge B is released, the process cartridge B falls on the developing unit D side about the cylindrical guides 13*a*R and 13*a*L and rises on the cleaning unit C side, and the regulating abutting portion 13*j* of the process cartridge B abuts against the fixed member 25 of the main body 14 of the image forming apparatus, and the process cartridge B is accurately mounted in the main body 14 of the image forming apparatus. Thereafter, the cover 35 is clockwise pivotally moved about a fulcrum 35*a* as viewed in FIG. 1 and is closed thereby.

To dismount the process cartridge B from the main body 14 of the image forming apparatus, a procedure converse to what has been described above is followed. That is, the cover 35 of the main body 14 of the image forming apparatus is opened and the aforementioned upper and lower ribs 11*c* forming the grip portion of the process cartridge B are gripped by a hand to thereby raise the process cartridge B, whereupon the cylindrical guides 13*a*R and 13*a*L of the process cartridge B pivotally move about the positioning grooves 16*b* and 16*d* of the main body 14 of the image forming apparatus, and the regulating abutting portion 13*j* of the process cartridge B separates from the fixed member 25 of the main body 14 of the image forming apparatus.

When the process cartridge B is then further pulled, the cylindrical guides 13*a*R and 13*a*L come out of the positioning grooves 16*b* and 16*d* and move to the guide portions 16*a* and 16*c* of the guide members 16R and 16L fixed to the main body 14 of the image forming apparatus, and when the process cartridge B is further pulled up, the cylindrical guides 13*a*R, 13*a*L and detent guides 13*b*R, 13*b*L of the process cartridge B move upwardly in the guide portions 16*a* and 16*c* of the main body 14 of the image forming apparatus. Thereby, the posture of the process cartridge B is regulated, and the process cartridge B is taken out of the main body 14 of the image forming apparatus without striking against other portions of the main body 14 of the image forming apparatus.

(Insulation Sheet Members)

Figure 13:
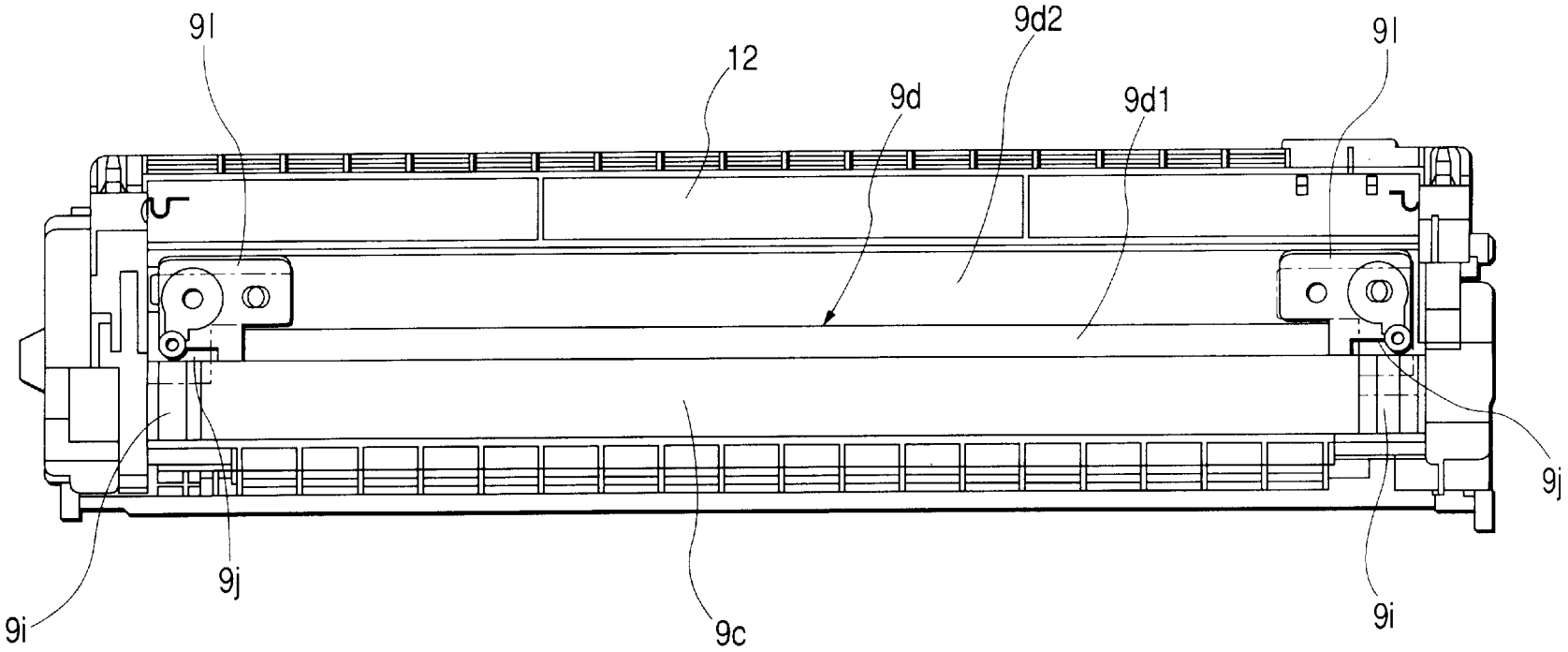
FIG. 13 is a front view showing a developing frame in the embodiment of the present invention.
Figure 14:
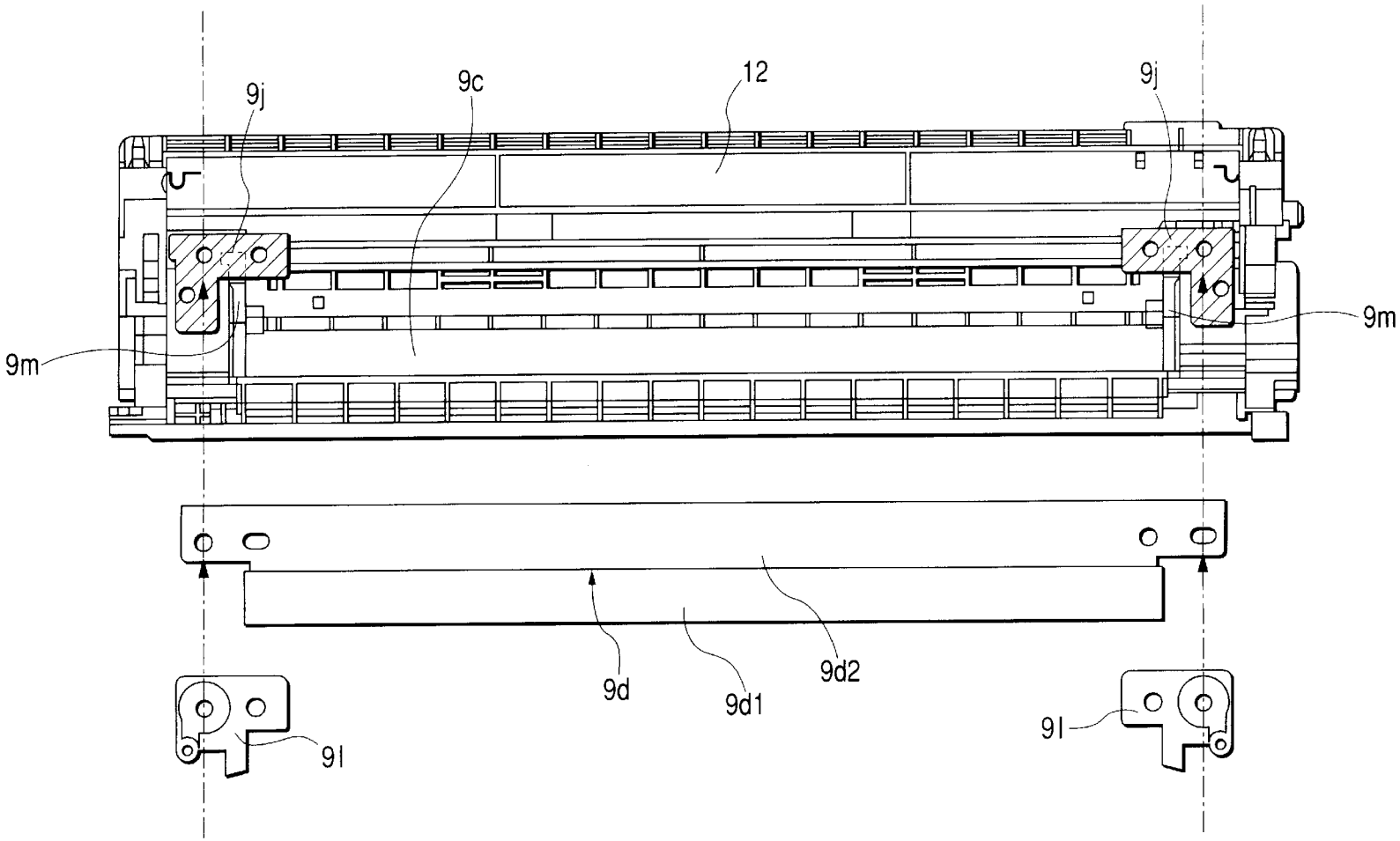
FIG. 14 is an exploded cross-sectional view showing the developing frame in the embodiment of the present invention.
Figure 15:
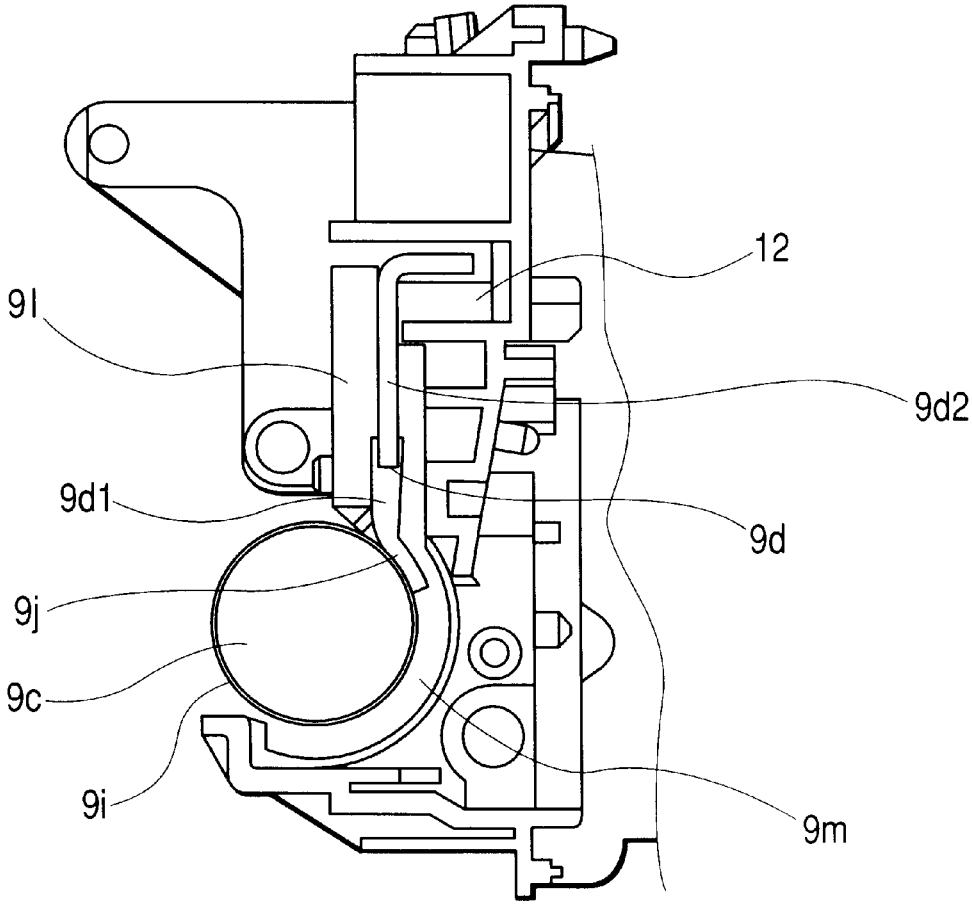
FIG. 15 is a side view showing the developing frame in the embodiment of the present invention.

Reference is now had to FIGS. 13 to 15 to describe the insulation sheet members 9*j* provided in the vicinity of the opposite end portions of the developing roller 9*c* which are a feature of the present embodiment. FIG. 13 is a front view showing the developing frame, FIG. 14 is an exploded cross-sectional view showing the developing frame, and FIG. 15 is a side view showing the developing frame.

The developing roller 9*c* is rotatably supported on the developing frame 12 of the process cartridge B, and spacer runners 9*i* are mounted on the lengthwisely opposite end portions thereof. The regulating blade 9*d* is comprised of an elastic member 9*d*1 abutting against the developing roller 9*c* along the lengthwise direction thereof for regulating the toner to a predetermined layer thickness, and a holding member 9*d*2 which holds the elastic member 9*d*1 and is a portion fixed to the developing frame 12. The holding member 9*d*2 is formed by an electrically conductive member.

The elastic member 9*d*1 of the regulating blade 9*d* presses the developing roller 9*c* and regulates the thickness of the layer of the toner borne and conveyed to the developing area by the developing roller 9*c*. Developer collecting blades 91 are disposed on the lengthwisely opposite end portions of the developing roller 9*c*, and prevent the toner on the developing roller 9*c* from leaking toward the spacer runners 9*i* by spattering or the like.

Also, in the vicinity of the lengthwisely opposite ends of the developing roller 9*c*, magnet seal members 9*m* are disposed with a predetermined gap between the magnet seal members 9*m* and the outer peripheral surface of the developing roller 9*c*, and the slippage, leakage or the like of the toner out of the developing frame 12 is prevented by the magnetic field action of the magnet seal members 9*m*. Also, between the holding member 9*d*2 of the regulating blade 9*d* and the magnet seal members 9*m*, the insulation sheet members 9*j* are interposed to prevent electrical leakage therebetween.

The insulation sheet members 9*j* are disposed at locations nipped between the magnet seal members 9*m* and the holding member 9*d*2 of the developing blade 9*d*, and are secured to the developing frame 12 with the developer collecting blade 91. Each insulation sheet members 9*j* extends to a position at which it abuts against the spacer runner 9*i*.

As described above, the insulation sheet members 9*j* abut against the surfaces of the spacer runners 9*i*, and when the developing roller 9*c* is rotated during development, the spacer runners 9*i* rotate while being in contact with the insulation sheet members 9*j*. Consequently, even if the spattered toner adheres onto the spacer runners 9*i*, it will be immediately scraped off by the insulation sheet members 9*j* and the toner will not be residual on the spacer runners 9*i*.

As described above, in the process cartridge B in the present embodiment, the insulation sheet members 9*j* are disposed in such a manner as to abut against the spacer runners 9*i* provided on the lengthwisely opposite end portions of the developing roller 9*c* and therefore, it becomes possible to scrape off the toner adhering onto the spacer runners 9*i* by the insulation sheet members 9*j*.

Accordingly, when image formation is effected with the process cartridge B mounted on the main body 14 of the image forming apparatus, the toner is prevented from adhering onto the spacer runners 9*i* by the spattering of the toner and therefore, the appropriate gap between the developing roller 9*c* and the photosensitive drum 7 can be stably maintained and good development can be effected for a long period.

Also, in the present embodiment, the toner can be prevented from adhering onto the spacer runners 9*i*, by a simple construction in which each insulation sheet member 9*j* extends to a position at which it abuts against the surface of the spacer runner 9*i* and therefore, no new toner removing member is required, but a reduction in cost becomes possible.

Also, while the image forming apparatus provided with the above-described process cartridge B in the present embodiment is an image forming apparatus for forming monochromatic images, the process cartridge according to the present invention can also be suitably applied to a process cartridge provided with a plurality of developing means for forming an image of plural colors (e.g. a two-color image, a three-color image or a full-color image).

Also, while in the above-described embodiment, a mono-component developing method is used as the developing method by the developing means, use can also be made of one of various developing methods such as a known two-component magnetic brush developing method, a cascade developing method, a touchdown developing method and a powder cloud developing method.

As described above, according to the present invention, at least a portion of the insulation sheet member for electrically insulating the holding member from the magnetism producing means is disposed so as to abut against the spacer runner for maintaining the spacing between the image bearing member and the developer bearing member constant, whereby even if the developer adheres onto the spacer runner 9*i*, it can be removed by the insulation sheet member and therefore, the appropriate gap between the developer bearing member and the image bearing member can be stably maintained, and good development can be effected for a long period.

The present invention is not restricted to the above-described embodiment, but also covers modifications identical therewith in technical idea.

What is claimed is:

1. A developing apparatus comprising:

a developer bearing member for bearing and conveying a developer, said developer bearing member having at a lengthwise end portion thereof a spacer for keeping a spacing between said developer bearing member and an image bearing member;

a sealing member for preventing the developer from leaking out of said lengthwise end portion of said developer bearing member;

a conductive member disposed in the vicinity of said sealing member; and an insulation member provided between said sealing member and said conductive member for electrically insulating said sealing member from said conductive member, wherein said insulation member has a cleaning portion for cleaning said spacer.

2. A developing apparatus according to claim 1, wherein said insulation member is a sheet having flexibility.

3. A developing apparatus according to claim 1, wherein said sealing member is a magnetic member, and said magnetic member is provided as to be opposed to an end of said developer bearing member with a gap therebetween to form a magnetic seal between said magnetic member and said developer bearing member.

4. A developing apparatus according to claim 1, further comprising a regulating member for regulating a thickness of a developer layer formed on said developer bearing member, wherein said conductive member is a metal plate holding said regulating member.

5. A developing apparatus according to claim 1, wherein said developing apparatus is detachably mountable on an image forming apparatus.

6. A developing apparatus according to claim 1, wherein said developing apparatus is constructed together with said image bearing member for bearing an image as a unit detachably mountable on an image forming apparatus.

* * * * *

UNITED STATES PATENT AND TRADEMARK OFFICE

CERTIFICATE OF CORRECTION

PATENT NO. : 6,606,469 B2 
DATED : August 12, 2003
INVENTOR(S) : Ken Kikuchi et al.

It is certified that error appears in the above-identified patent and that said Letters Patent is hereby corrected as shown below:

Column 2,
Line 15, “invention” should read -- invention is --.

Column 3,
Line 46, “an” should read -- a --.

Column 4,
Line 23, “tone” should read -- toner --.

Column 5,
Line 17, “parallelism to” should read -- parallel with --.

Column 9,
Line 40, “members” should read -- member --.

Signed and Sealed this

Eighteenth Day of November, 2003

JAMES E. ROGAN
*Director of the United States Patent and Trademark Office*